US005737430A

United States Patent [19]

Widrow

[11] Patent Number: 5,737,430

[45] Date of Patent: Apr. 7, 1998

[54] DIRECTIONAL HEARING AID

[75] Inventor: Bernard Widrow, Santa Clara County, Calif.

[73] Assignee: Cardinal Sound Labs, Inc., Stanford, Calif.

[21] Appl. No.: 730,807

[22] Filed: Oct. 16, 1996

Related U.S. Application Data

[63] Continuation of Ser. No. 328,512, Oct. 25, 1994, abandoned, which is a continuation of Ser. No. 95,736, Jul. 22, 1993, Pat. No. 5,363,680.

[51] Int. Cl.[6] ..... H04R 25/00

[52] U.S. Cl. ..... 381/68.1; 381/68; 381/68.6

[58] Field of Search ..... 381/68, 68.1, 68.6, 381/68.2, 68.3, 151, 68.5, 183, 187, 25

[56] References Cited

U.S. PATENT DOCUMENTS

| | | | |
|---|---|---|---|
| 3,985,977 | 10/1976 | Beaty et al. | 381/68 |
| 4,070,553 | 1/1978 | Hass | 381/22 |
| 4,751,738 | 6/1988 | Windrow et al. | 381/68.1 |
| 5,289,544 | 2/1994 | Franklin | 381/68.1 |
| 5,425,104 | 6/1995 | Shennib | 381/68 |

*Primary Examiner*—Sinh Tran

*Attorney, Agent, or Firm*—Flehr Hohbach Test Albritton & Herbert LLP

[57] ABSTRACT

Disclosed is a convenient way of mounting the microphone array and associated electronics of a hearing aid on the person, and providing a convenient wireless means for delivering the microphone signals to the ear, and providing a signal processing technique that yields sharp directivity at audio frequencies. The wearer positions her/his body to receive the desired signal and to attenuate surrounding background noise and multipath interference.

4 Claims, 3 Drawing Sheets cardioid: 500 Hz, 5 elements, 3.25 cm cardioid: 1000 Hz, 5 elements, 3.25 cm cardioid: 2000 Hz, 5 elements, 3.25 cm cardioid: 4000 Hz, 5 elements, 3.25 cm

DIRECTIONAL HEARING AID

This is a continuation of application Ser. No. 08/328,512, filed Oct. 25, 1994, abandoned, which is a continuation of prior application Ser. No. 08/095,736, Jul. 22, 1993, now U.S. Pat. No. 5,365,680.

FIELD OF THE INVENTION

This invention relates generally to hearing aids, and more particularly to directional hearing aids which both respond to sound in the look direction and minimize the effect of sound coming from the sides and the rear.

BACKGROUND OF THE INVENTION

It has been found that under certain circumstances, for persons with a particular but not unusual type of hearing defect, hearing aids providing good directional response are very effective. People whose hearing handicap is that they are deaf in one ear but have at least some minimal level of hearing in the other ear find it very difficult to tune into and understand a particular speaker or sound source in the presence of other background noise sources. Persons with such a single ear hearing loss are able to hear with their good ear, but are unable to differentiate and separate the sounds from various sources. In other words, they are able to hear, but unable to understand. This phenomenon is known as the "cocktail party" effect. It makes it extremely difficult for a monaurally handicapped person to participate effectively in a situation with multiple sound sources such as a group discussion or at a cocktail party.

Among the devices proposed in the prior art, and currently commercially available, one which has achieved some popularity is known as the cross-aid device. This device consists basically of a subminiature microphone located on the user's deaf side, with the amplified sound piped into the good ear. While this compensates for deafness on one side, it is not very effective in reducing the cocktail party problem. Other efforts in the prior art have been largely directed to the use of moving, rotatable conduits which can be turned in the direction which the listener wishes to emphasize (see for example U.S. Pat. No. 3,983,336). Alternatively, efforts have also been made in using movable plates and grills to change the acoustic resistance and thus the directive effect of a directional hearing aid (see U.S. Pat. No. 3,876,843 Moen). None of these efforts have proved to be satisfactory. Old fashioned ear trumpets had been effective in providing amplification and directionality, but they went out of favor with the advent of electronic hearing aids.

A hearing aid invented by Widrow and Brearley (U.S. Pat. No. 4,751,738) has useful directional properties. Not disclosed in the '738 patent is a convenient way of delivering signals to the ear or a convenient way of mounting the microphone array and associated electronics on the person.

OBJECTS AND SUMMARY OF THE INVENTION

It is an object of this invention to overcome limitations of the prior art, primarily limitations of the Widrow-Brearley patent, by providing a convenient means for mounting the microphone array and associated electronics on the person, and providing a convenient wireless means for delivering the microphone signals to the ear.

It is another object of the invention to provide a signal processing technique that yields sharp directivity at higher frequencies.

There is provided a directional heating aid which includes an array of microphones adapted to be worn by a user for receiving and generating electrical signals representing sound whereby the user can position her/his body to receive sound from a desired direction, and which also includes electronic means for receiving electrical output signals from the microphone array and generates auditory signals representing sound received from a desired direction while attenuating background noise and multipath interference.

BRIEF DESCRIPTION OF THE DRAWINGS

The foregoing and other objects of the invention will be more clearly understood from the following detailed description when read in conjunction with the accompanying drawings, wherein.

DESCRIPTION OF PREFERRED EMBODIMENT

Figure 1:
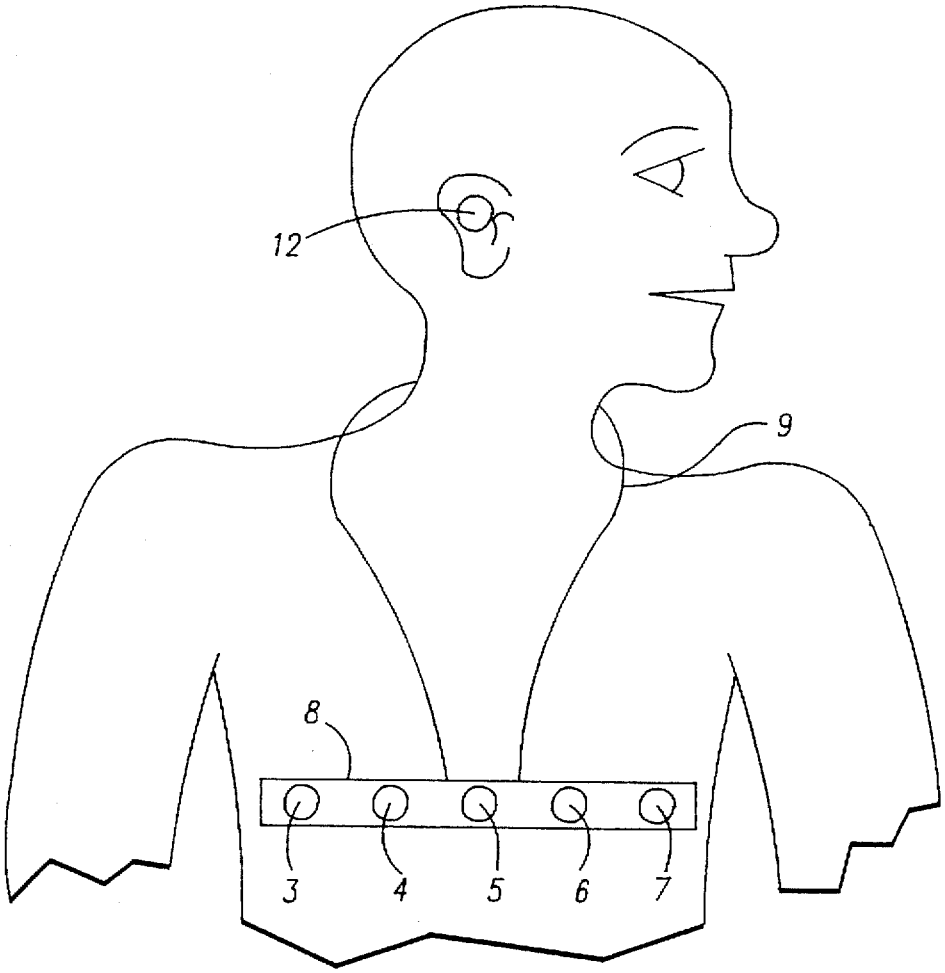
FIG. 1 shows a directional hearing aid in accordance with the invention, worn by a person.

Referring to FIG. 1, a 5-microphone array 3–7 is mounted on a suitable mounting means such as a package 8 along with its associated electronics, such as the system described in Widrow et al. U.S. Pat. No. 4,751,738, and battery. One could use in its place a single directional microphone, or an array having two or more microphones. The neck loop 9 serves to support the package 8 from the wearer's neck. The neck loop is responsive to signals from the electronics to generate a magnetic field. The microphones are preferably mounted along a horizontal line. But they could be displaced a fraction of the array width in the vertical direction relative to each other without significantly impairing functionality.

As is known, modern hearing aids, worn in the ear or behind the ear, can be equipped with "telecoils." The purpose of the telecoil is to facilitate telephone communication. The telephone receiver uses magnetic forces to move a diaphragm and generate sound. A magnetic field whose strength is proportional to the instantaneous sound amplitude leaks from the telephone receiver. A hearing aid equipped with a telecoil can be switched from "M" (microphone) to "T" (telecoil). When on M, the standard microphone signal is amplified and heard by the wearer. When on T, the signal induced into the telecoil, a coil of wire encased inside the hearing aid, is amplified and heard by the wearer.

When on T, and when the telephone receiver is placed near the hearing aid, the telephone conversation is heard clearly by the wearer. The coil in the telephone receiver acts like the primary of a transformer and the telecoil acts like the secondary and thereby obtains the telephone signal. Addition of the telecoil feature increases the cost of the hearing aid by about 10%, but it gives a clear telephone signal without feedback squeals that often result when telephoning without a telecoil.

The existence of the telecoil is exploited by the present invention. The magnetic field from the neck loop 9 induces signal in the telecoil of the hearing aid 12. The Widrow-Brearley signal described in U.S. Pat. No. 4,751,738 and incorporated herein by reference is transmitted clearly to the wearer by wireless magnetic coupling between the neck loop 9 and the hearing aid 12.

The neck loop can be comfortably worn in an unobtrusive manner under a shirt or sweater. Alternatively, it can be a piece of jewelry worn on the chest outside of clothing to support the package.

An alternative to the Widrow-Brearley directional array simply adds all the signals of an array of microphones instead of adding them in pairs and separately band-pass filtering each pair to cover a specified fraction of the audio frequency range. The simple additive array derives a signal without requiring many band pass filters. The implementation is cheaper. The result is a more directional receiving array whose beam width narrows as the frequency rises. The microphones could be uniformly or non-uniformly spaced. The spacing has an effect on the shape of the directivity pattern and how it varies with frequency.

Figure 2:
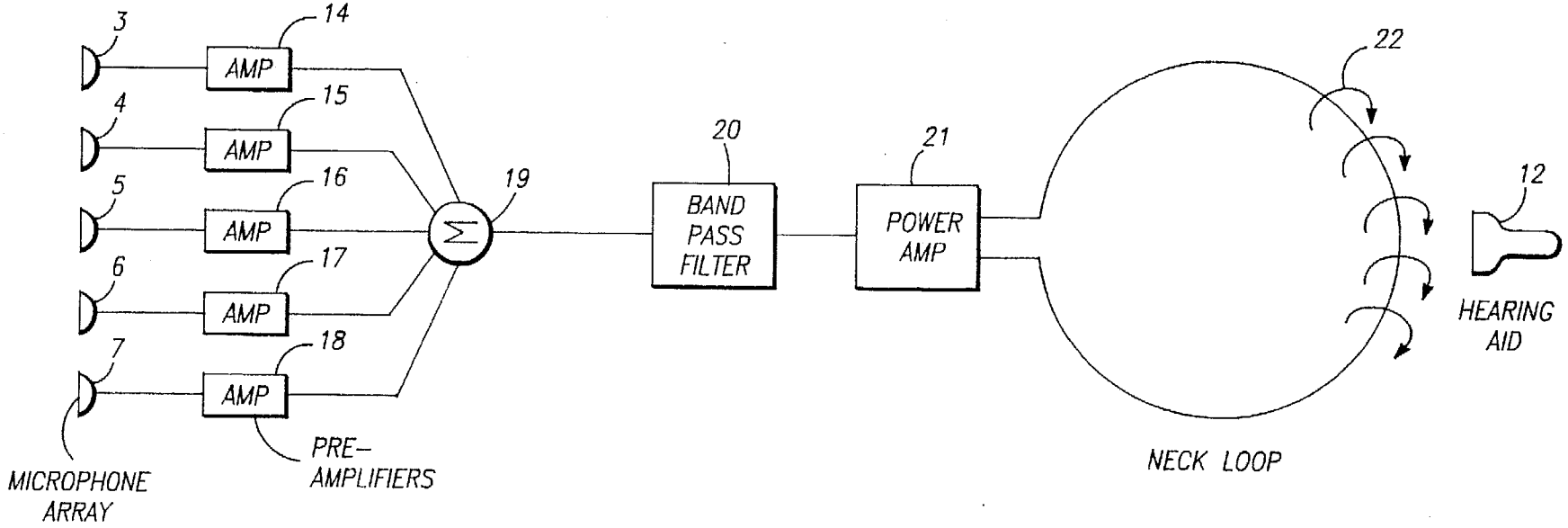
FIG. 2 shows a directional hearing aid system for transmitting signals from a microphone array to a hearing aid.
Figure 3A:
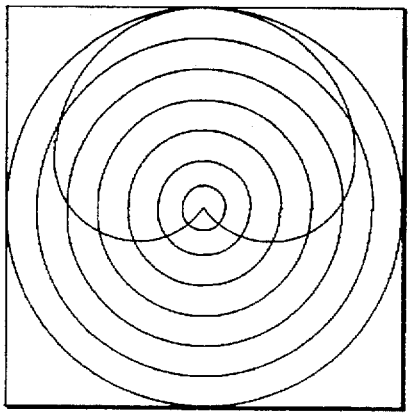
FIGS. 3A–3D show the directivity patterns for a five-microphone array at four different frequencies.
Figure 3B:
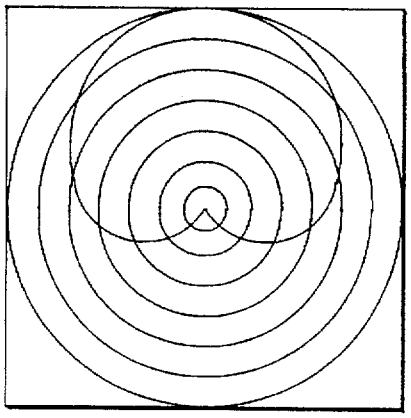
Figure 3C:
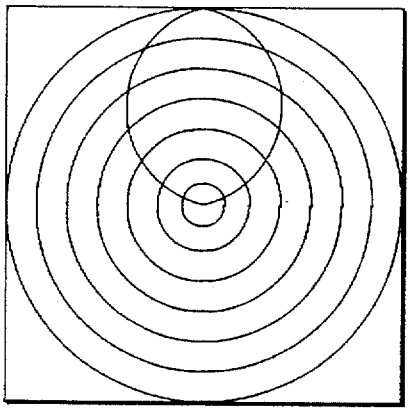
Figure 3D:
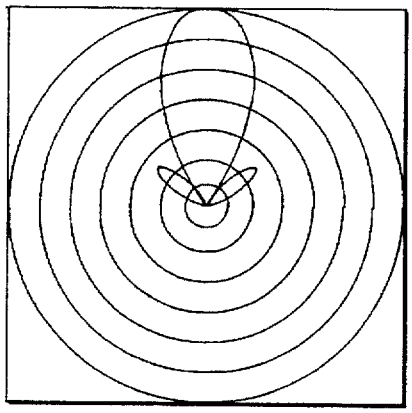

FIG. 2 shows the array of microphones 3–7, whose signals are amplified by preamplifiers 14–18. The preamplifier may be built into the same package as the microphone. The amplified signals are summed by summer 19, generally an operational amplifier. The resulting array output signal is usually band pass filtered 20 to limit the signal to the audio band (approx. 1–6 kHz) and further amplified by amplifier 21 to raise the power level. The output of the power amplifier can be used to drive neck loop 9 to generate magnetic flux 22, which is coupled to the hearing aid 12 as described above. The output could drive headphones or some other form of telemetry to send the signal from the chest mounted array to the hearing aid in or behind the ear. Other forms of telemetry could be radio-frequency electromagnetic radiation, infra-red radiation, ultrasonic radiation, electric currents in the body, or a wire connection to the hearing aid.

In a preferred embodiment, the package contains the microphone array, batteries and signal processing and amplifying electronics. There are no exterior wires except the neck loop, which is comfortable and convenient to wear as a necklace. It couples the signal magnetically to the conventional hearing aid to provide a signal to the user, obviating the need for a wire connection.

Placing the microphone array on the chest has other advantages over placement on the spectacle frames or the usual placement of the microphone in a conventional hearing aid. On the chest, the microphone array is situated far from the loudspeaker of the hearing aid. Acoustic coupling and feedback are greatly reduced, so that the signal level into the ear can be substantially raised, if desired, without causing oscillation. Using this system, people with profound hearing loss are able to distinguish spoken words in noisy environments and in rooms with bad multipath and reverberation. The directional nature of the array and processor reduce surrounding interference and reduce signals reflected from walls of a room that arrive at the ear from different angles of arrival and at different times and cause confusion. To have a conversation, the wearer simply turns his or her body toward the person speaking. A direct clear signal is received.

When using either the Widrow-Brearley array or the simple additive array, the resulting signal can be used to drive a neck loop to provide magnetic coupling to a conventional hearing aid through its telecoil. If the user wears hearing aids in both ears, both hearing aids could be equipped with telecoils so that the array signal could be received by both hearing aids. This has been tried and it is very effective. Other arrays can also be used. Adaptive noise canceling arrays developed by Widrow, B., and Stearns S. D. (1985), *Adaptive Signal Processing* (Prentice-Hall, Englewood Cliffs, N.J.); by Griffiths, L. J., and Jim, C. W. (1982), "An alternative approach to linearly constrained adaptive beamforming," IEEE Trans. Antennas Propag. AP-30, 27–34; and by Greenberg, J. E., and Zurek, P. M. (1992), "Evaluation of an Adaptive Beam forming Method for Hearing Aids," J. Acoust. Soc. Am., Vol. 91, No. 3, March 1992, 1662–1676; can be used to supply signal via the neck loop to the telecoil.

FIGS. 3A–3D show directivity patterns for a simple, 5-microphone additive array of cardioid elements. The distance between the microphones is 3.25 cm. The circular rings are spaced 3 db apart. Plots are shown for 500 Hz, 1000 Hz, 2000 Hz, and 4000 Hz. Notice that the beam pattern narrows as the frequency increases and becomes quite sharp at high frequency. The beam patterns of the Widrow-Brearley array remain approximately the same across the audio range.

With the simple additive array, the element spacings could be made non-uniform. Useful results are obtained, but they generally exhibit larger side lobes and wider beam widths. Uniform spacing generally gives the best performance.

Many different modalities are available for carrying the array output signal from the chest up to the ear. Some are radio-frequency electromagnetic transmission, ultrasound, infra-red transmission, conduction currents through the body, and a direct wire connection. The advantage of induction coupling using the neck loop and telecoil is that it is wireless, and that it requires no modification to the standard hearing aid.

Many people who do not wear hearing aids have great difficulty understanding speech in a noisy and/or reverberant place. These people would benefit from listening through a chest-mounted directional system, such as the Widrow-Brearley array or the simple additive array. They could listen with headphones or "ear buds" connected to the array output.

When using the Widrow-Brearley array processor, separate gain controls and automatic gain controls (AGC) can be applied to different portions of the spectrum. With three microphones, the Widrow-Brearley processor separates the sound into three independent frequency bands, making it easy to incorporate three independent gain controls. With more microphones, there would be more separate frequency bands whose gains could be controlled. Shaping the frequency response is important for users whose natural response is non-uniform. Low user sensitivity at high frequencies requires higher system gain at high frequencies, etc. Other types of arrays would require band-pass filtering to separate the frequencies into bands before independent gain controls would be possible.

Other modifications and improvements may occur to one of skill in the art who studies the foregoing patent; therefore the scope of the present invention is to be limited only by the following claims.

What is claimed:

1. A directional hearing aid system including:

an electromagnetic acoustic transducer adapted to be worn in the ear by a user, an array of spaced microphones for receiving sound and each generating electrical microphone signals representing the sound received by each microphone, electronic means for receiving each of said electrical microphone signals from the microphone array and generating an output signal representing sound received from a selected direction while attenuating background noise and multipath interference, an elongated package means extending across the chest of the user for mounting said array of spaced microphones and housing said electronic means, a conductive neck encircling the neck of the user and secured to the package means at spaced locations to solely directly support the elongated package means and the microphone array substantially horizontally across the chest of the user so the user can position her/his body to receive sound from the selected direction with the back of the user's body blocking sound to all of the microphones from the opposite direction, said neck loop connected to receive said output signal and generate magnetic fields responsive thereto, and said electromagnetic acoustic transducer including a telecoil coupled to said magnetic fields for applying signals to said electromagnetic acoustic transducer to generate acoustic waves in said ear of the user.

2. A directional hearing aid as in claim 1 wherein said electronic means for generating output signal includes summing means for receiving and summing said electrical microphone output signals from all of the microphones in said array to provide summed signals and filter means for filtering the summed signals to limit the frequencies of the output signals to audio band frequencies.

3. A directional hearing aid system including an electromagnetic acoustic transducer worn in the ear of a user, comprising:

an elongated housing, an array of spaced microphones mounted in said housing for receiving sound from a selected direction and each generating electrical microphone signals representing sound received by each of said microphones in said array, electronic means mounted in said housing for receiving said electrical microphone signals from the microphone array and generating an output signal representing sound received from the selected direction while attenuating background noise and multipath interference, a conductive loop secured to said elongated housing at spaced points for solely directly supporting said elongated housing, including said microphone array and said electronic means, in a fixed position across the chest of the user so the user can position her/his body to receive sound from said selected direction with the back of the user's body blocking sound to all of said microphones from the opposite direction, means for applying said output signal to said conductive loop to generate magnetic fields, and coil means in said electromagnetic acoustic transducer for receiving said magnetic fields and for providing electrical signals representative of said magnetic fields to said acoustic transducer, said electromagnetic acoustic transducer generating acoustic signals in the ear of the user responsive to said electrical signals.

4. A directional hearing aid system including:

an electromagnetic acoustic transducer adapted to be worn by a user, an array of three or more spaced microphones for receiving sound and each generating electrical microphone signals representing the sound, electronic means for receiving said electrical microphone signals from the array of microphones and generating an output signal representing sound received from a direction in front of the user while attenuating background noise and multipath interference, said electronic means for generating an output signal including a single summing means for receiving and summing the electrical output signals from all of the microphones in the array of microphones to provide a summed signal and single filter means for filtering the summed signal to limit the frequencies of the summed signal to the audio band of frequencies, elongated package means for supporting said array of spaced microphones and housing said electronic means, means for supporting said elongated package means at spaced points in a fixed position on the chest of the user whereby the user can position her/his body to receive sound from said direction with the back of the user's body blocking sound to each of said microphones from the rear of the user, and said electromagnetic acoustic transducer serving to receive said summed signal and to generate acoustic waves in the ear of the user.

* * * * *